US006224501B1

(12) United States Patent
Rudduck et al.

(10) Patent No.: US 6,224,501 B1
(45) **Date of Patent: *May 1, 2001**

(54) GOLF TEE

(75) Inventors: Dickory Rudduck, Seaforth; Leonard John Dwyer, Turramura, both of (AU)

(73) Assignee: IX Golf Pty Limited, Sydney (AU)

( * ) Notice: Subject to any disclaimer, the term of this patent is extended or adjusted under 35 U.S.C. 154(b) by 0 days.

This patent is subject to a terminal disclaimer.

(21) Appl. No.: 08/857,571

(22) Filed: May 16, 1997

Related U.S. Application Data

(63) Continuation of application No. 08/432,156, filed as application No. PCT/AU93/00042 on Feb. 1, 1993, now abandoned.

(30) Foreign Application Priority Data

| | | |
|---|---|---|
| Oct. 27, 1992 | (AU) | PL5511 |
| Nov. 16, 1992 | (AU) | PL5858 |

(51) Int. Cl.[7] ..... A63B 57/00
(52) U.S. Cl. ..... 473/401
(58) Field of Search ..... 473/387–403, 473/406; 401/49, 55; 15/424, 425, 427

(56) References Cited

U.S. PATENT DOCUMENTS

| | | | | |
|---|---|---|---|---|
| D. 85,229 | | 9/1931 | Cannon . | |
| 727,398 | * | 5/1903 | Mack | 15/427 |
| 1,224,992 | * | 5/1917 | Ziemer | 15/427 |
| 1,278,147 | | 9/1918 | Hess | 273/203 |
| 1,522,544 | * | 1/1925 | Pryde | 273/33 |
| 1,573,911 | * | 2/1926 | Budrow | 273/211 |
| 1,588,038 | * | 6/1926 | Miller | 273/212 |
| 1,588,815 | | 6/1926 | Sillcocks . | |
| 1,616,683 | * | 2/1927 | Eddy | 273/33 |
| 1,625,911 | | 4/1927 | Richards . | |
| 1,655,571 | * | 1/1928 | Cody | 473/393 |
| 1,670,123 | * | 5/1928 | Ranseen | 273/212 |
| 1,679,579 | * | 8/1928 | Lundy | 273/207 |
| 1,730,046 | | 10/1929 | Stow . | |
| 1,959,347 | | 5/1934 | Czichos . | |
| 2,029,767 | * | 2/1936 | Eisenhauer | 401/55 |
| 2,391,392 | * | 12/1945 | Coffin | 273/33 |
| 2,470,817 | * | 5/1949 | Hendricks | 473/396 |
| 2,747,768 | | 5/1956 | Raines . | |
| 3,273,890 | | 9/1966 | Williams . | |
| 3,633,919 | * | 1/1972 | Liccardello | 473/386 |
| 4,516,773 | * | 5/1985 | Martin | 473/406 |
| 4,516,780 | | 5/1985 | Tabet . | |
| 4,893,818 | * | 1/1990 | Liccardello | 473/406 |
| 5,149,088 | | 9/1992 | O'Hara . | |
| 5,720,677 | * | 2/1998 | Rudduck | 473/387 |

FOREIGN PATENT DOCUMENTS

| | | | |
|---|---|---|---|
| 238599 | 5/1924 | (GB) . | |
| 267820 | 3/1927 | (GB) . | |
| 326915 | 3/1930 | (GB) . | |
| 427478 | 4/1935 | (GB) . | |
| 525115 | 8/1940 | (GB) | 273/212 |
| 2080121 | 2/1982 | (GB) . | |
| 2227416 | 8/1990 | (GB) | 273/33 |
| 4009866 * | 5/1994 | (WO) | 273/33 |
| 4011066 * | 5/1994 | (WO) | 273/33 |

* cited by examiner

*Primary Examiner*—Steven Wong
(74) *Attorney, Agent, or Firm*—Brinks Hofer Gilson & Lione

(57) ABSTRACT

The invention relates to a golf tee (10) which includes a writing point (18) and an eraser (12).

In a preferred embodiment, tee (10) has shaft (11) and head (12), shaft (11) tapering from head (12) to end (13).

Received in cylindrical bore 17 is writing point 18 having free end 19.

Hollow bore 16 is adapted to receive end 13A of second tee 10A, thus protecting writing point 18A.

Circumferential rim (14) defines a hollow depression (15) which is intended to aid in support of a golf ball.

42 Claims, 2 Drawing Sheets

GOLF TEE

This application is a continuation of Ser. No. 08/432,156 filed Apr. 27, 1995 now abandoned, which is a 371 of PCT/AU93/00042 filed Feb. 1, 1993.

TECHNICAL FIELD

This invention relates to a sporting apparatus. In particular, this invention relates to apparatus which is useful in connection with the game of golf.

BACKGROUND ART

During golf play, it is permissible to use a golf tee—usually a small wooden or plastic peg—to hold a golf ball in an elevated position before striking it with a golf club. The rules of golf normally provide for the use of a golf tee in this manner for the first stroke of each hole.

The appearance and manufacture of conventional golf tees is well known. The conventional tee has a (usually concave) head, on which a golf ball may be supported, and a shaft, usually ending in a point, to enable the tee to be driven into the ground.

During play, it is customary for each player to enter the number of strokes he makes on a score card, using a score pencil. Occasionally, if a player makes an error in entering his score, it may be desirable to use an eraser to enable the error to be corrected.

Before now, during a round of golf, most golfers found it necessary to carry an assortment of golf tees, score pencils and erasers. Many players have suffered inconvenience from time to time through failure to maintain an adequate inventory of these items, or through an inability to readily locate each item when required.

It is an object of this invention to overcome or at least alleviate these problems and to provide a golf tee which combines the function of score pencil and/or eraser.

DISCLOSURE OF THE INVENTION

Accordingly, this invention provides a golf tee which includes a writing point and an eraser.

The golf tee may be made of any appropriate material. As indicated above, it is usual to construct a tee of wood or moulded plastic. These materials are relatively inexpensive. However, golf tees are sometimes made of other material, including common metals and even silver and gold. All such materials may be used in the manufacture of the golf tee of the present invention.

The writing point may comprise any suitable writing means, including pencil lead, ball point with associated ink reservoir, crayon, or the like. If desired, the writing point may be retractable. If appropriate, a major part of the tee may be made from a material which is capable of marking paper and the like.

The eraser is conveniently rubber, felt or another natural or synthetic material suitable for erasing writing.

Ideally the eraser material is effective to erase writing made by the writing point. Thus, where the writing point comprises a pencil lead, the eraser material should be capable of erasing pencil writing. Similarly, when the writing point comprises a ball point pen, the eraser material should be capable of erasing ink writing.

The eraser may be configured to function as a shock absorber. This function may be in addition to or in substitution for the ability of the eraser to erase writing. Where the eraser is configured to act as a shock absorber, the material of the eraser should be less hard than that of a golf ball.

In its most convenient configuration, the writing point is coaxial with the shaft and is contained within or forms part of the shaft of the tee. Preferably, the writing point forms the end of the shaft for permitting the tee to be driven into the ground. In this embodiment, the writing point should be selected from materials which will have the desired degree of hardness, so that the writing point resists damage when driven into the ground. (Of course, it will be appreciated that conventional tees are often damaged when attempts are made to drive them into very compacted earth or the like; similar damage may be encountered in the case of the tee of the present invention and must be regarded as difficult to avoid. When the writing point comprises a ball point pen, the metal reinforcing normally present will help to avoid this type of damage.)

The eraser is conveniently located at or near the head of the tee. The eraser may take any appropriate form. For example, the eraser may replace the head of the tee entirely. In this form, the eraser may be integrally moulded with the shaft of the tee, even to the extent of forming the shaft, or affixed to the shaft by suitable means.

In another form, the eraser may consist of an "O" ring or a split ring received in a channel or groove around the head of the tee.

Other forms will be apparent to one skilled in the art and are within the scope of this invention.

Optionally, a plurality of golf tees of the invention may be adapted to nest together, the point of the shaft of one tee being receivable in a hollow bore extending from the head into the shaft of the next tee.

If desired, the head of the tee of the invention may be adapted to receive a disc, which can display advertising or identifying matter, or a ball marker. This is an especially convenient configuration when the tee of the invention includes an eraser located at the head of the tee, because the eraser can be made of suitably resilient material to form a ledge for holding the disc or marker. The disc may be inserted during manufacture or by the player, for example.

BRIEF DESCRIPTION OF THE DRAWINGS

Certain preferred embodiments of the invention will now be described by way of example, with reference to the accompanying Drawings, in which.

In the Drawings, for convenience the same numerals will be used to identify corresponding parts.

Figure 1:
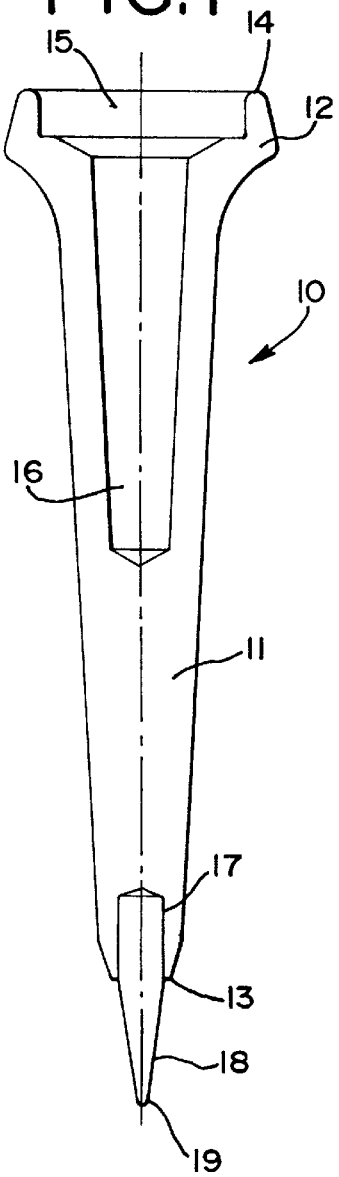
FIG. 1 is a cross-sectional view of a first embodiment of the tee of the invention.

Referring first to FIG. 1, golf tee 10 is moulded in one piece from eraser material to form shaft 11 and head 12. Shaft 11 tapers from head 12 to end 13. Head 12, which is of greater diameter than shaft 11, has a circumferential rim 14 defining a hollow depression 15 which provides a concave surface for supporting a golf ball (not shown).

Hollow bore 16 extends axially in shaft 11 from hollow depression 15 towards end 13 and is tapered so that at least part of the shaft of an identical tee 10 can be received therein, as described below.

Formed in shaft 11 is cylindrical bore 17 which extends axially in shaft 11 from end 13 towards head 12. Writing point 18 consists of a pencil lead tapering towards its free end 19. Writing point 18 is mounted in bore 17 and held therein by friction, adhesive or any other suitable means. The eraser material comprising shaft 11 and head 12 is suitable to erase writing made by writing point 18.

When golf tee 10 is used as a tee, it may be inserted in the ground, using free end 19 to assist in penetrating the ground. A golf ball may then be placed on head 12, protruding partly into hollow depression 15, and hit therefrom in the usual manner. Tee 10 may then be recovered from the ground, and, by holding tee 10 as a pencil, writing point 18 may be used to mark the stroke on a score card, or to note other information, if desired. Head 12 may be used to erase marks made by writing point 18.

Figure 2:
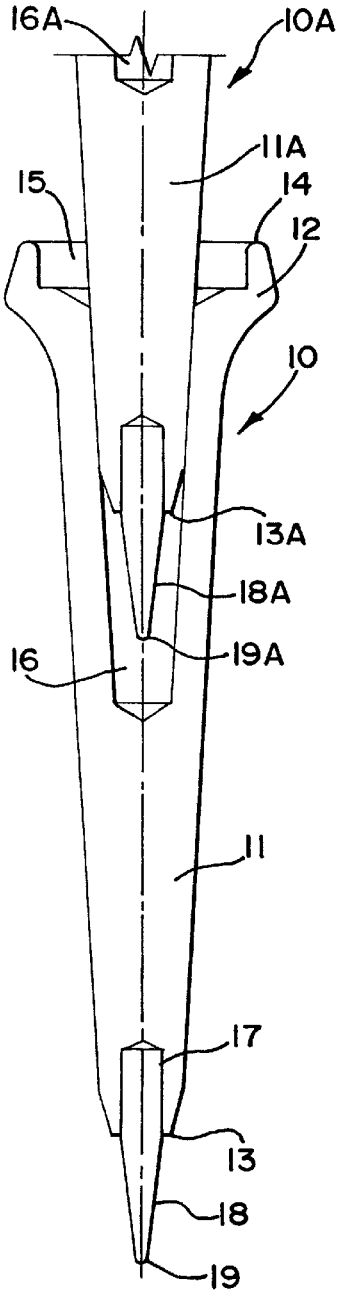
FIG. 2 shows how the tee of FIG. 1 can nest with like tees.

Referring now to FIG. 2, first tee 10 is nested with a second tee 10A (of which only the lower portion appears in FIG. 2). End 13A of second tee 10A is inserted in hollow bore 16 of the first tee 10, thus protecting writing point 18A. It will be appreciated that a number of tees 10 may be nested in this manner, thereby protecting all the writing points 18, with the exception of that of the lowermost tee 10. In addition, nested tees are more convenient to carry and to use for writing.

Figure 3:
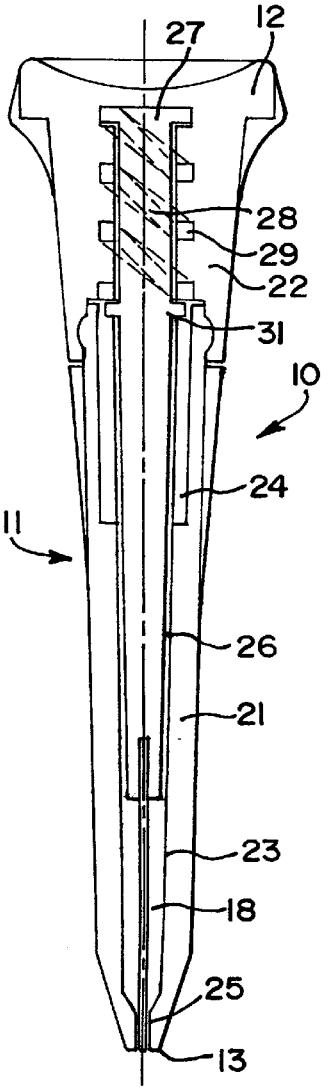
FIG. 3 illustrates in cross-sectional view a second embodiment of the tee of the invention.

FIG. 3 shows a more complex embodiment of the invention.

In this embodiment, shaft 11 is made up of a lower part 21 and a separate upper part 22. In lower part 21 is axial bore 23 which communicates with larger diameter bore 24 at one end and with smaller diameter bore 25 at the other end, adjacent end 13.

Pencil lead holder 26 contains writing point 18 in the form of a pencil lead, adapted to feed through bore 25. Pencil lead holder 26 includes threaded portion 27 having threads 28 which cooperate with threaded portion 29 in upper part 22 of shaft 11. Stop flange 31 limits the extent of travel of holder 26.

Rotation of upper part 22 in one direction causes writing point 18 from holder 26 to be fed through bore 25, while rotation in the reverse direction causes writing point 18 to be retracted into bore 25, in the manner of a propelling pencil. In this way, writing point 18 can be protected from damage when tee 10 is driven into the ground.

Upper part 22 of shaft 11 comprises or includes an eraser.

Ideally the whole of part 22 is made from eraser material. Otherwise head 12 can be made from such material and bonded to the remainder of part 22 in a suitable manner.

Figure 4:
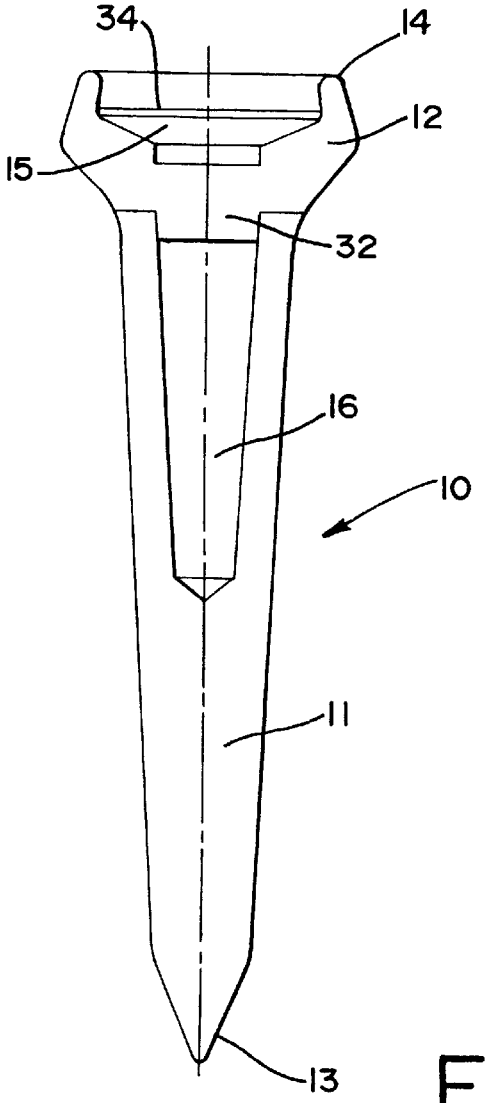
FIG. 4 shows, again in cross-sectional view, a third embodiment of the tee of the invention.

FIG. 4 illustrates an embodiment of the invention in which tee 10 has an eraser and a shaft comprising a writing point. In this embodiment, head 12 is made of eraser material and includes extended portion 32 so that head 12 can be joined to shaft 11 by frictional fit. Shaft 11 is constructed from material suitable to mark a score card, and so comprises a writing point.

Removably inserted in hollow depression 15 is ball marker 34, which is held in place by ledge or rim 14 of head 12. To facilitate removal of marker 34, rim 14 may be partly cut away (not shown) for part of its circumference.

In this embodiment, head 12 may also function as a shock absorber, when a golf ball (not shown) is hit from head 12 of tee 10.

Figure 5:
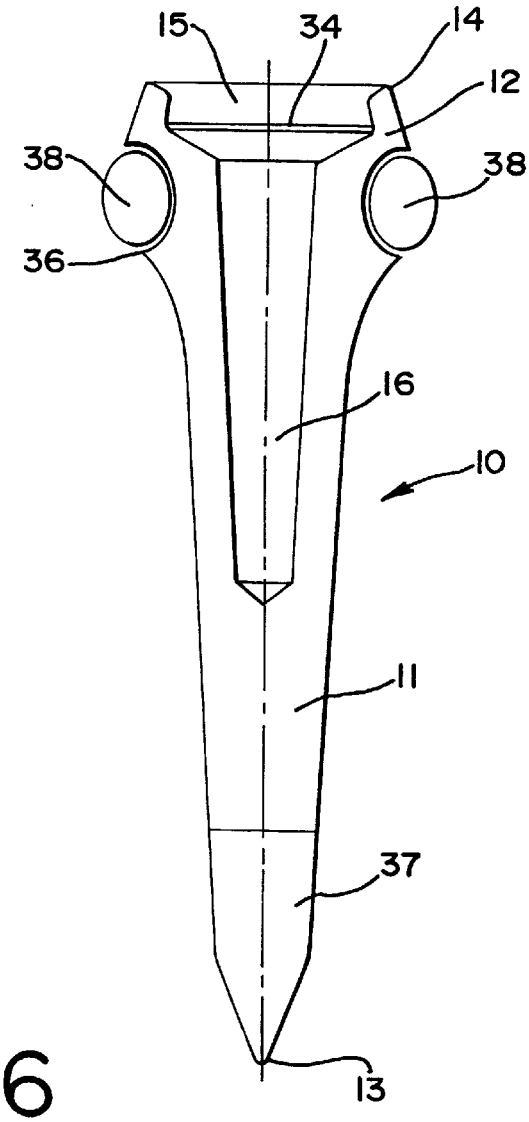
FIG. 5 illustrates a fourth embodiment of the tee of the invention, in cross-sectional view.

In the embodiment in FIG. 5, head 12 has a circumferential channel 36 in which is received O-ring (or split ring) 38, which comprises the eraser. In this embodiment, when compared with that in FIG. 4, it will be noted that part of rim 14 has been omitted to enable easy removal of marker 34.

Lower portion 37 of shaft 11 is made from material, such as carbon, capable of use as a writing point.

In a variation of this embodiment, the whole of shaft 11 and head 12 could be made from such a material.

Figure 6:
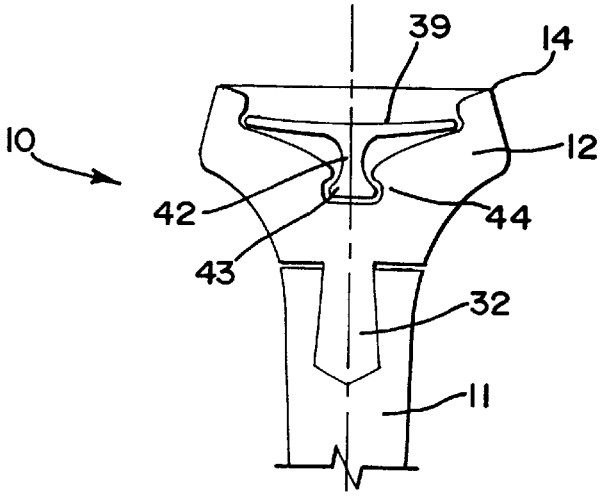
FIG. 6 shows, in cross-sectional view, detail of a fifth embodiment of the tee of the invention.

Referring now to FIG. 6, tee 10 has head 12 consisting of eraser material, with extended portion 32 bonded to shaft 11 by adhesive. Advertising disc 39 includes shaft 42 having flange 43 received in cavity 44 of head 12, so that disc 39 is retained in head 12 for normal use, but can be exchanged for an alternate advertising disc if desired.

Shaft 11 may comprise a writing point, as in the embodiment illustrated in FIG. 4, or may contain or be joined to a writing point, as the embodiments in FIGS. 1 or 5.

INDUSTRIAL APPLICABILITY

It will be appreciated that the golf tee of the invention represents a significant advancement over the prior art, combining the functions of a tee, together with that of a writing instrument and an eraser. It will also be appreciated that the scope of the invention is not limited to the embodiments described above.

What is claimed is:

1. A golf tee having an enlarged head defining a hollow depression to provide a concave surface for supporting a golf ball, the golf tee comprising an eraser located at the head and a writing point.

2. A golf tee as claimed in claim 1, wherein the tee includes a writing point chosen from the group consisting of pencil lead, ball point with associated ink reservoir and crayon.

3. A golf tee as claimed in claim 1, wherein at least a part of the tee is made from a material which is capable of use as a writing point.

4. A golf tee as claimed in claim 3, wherein the tee has a shaft made from the material capable of use as a writing point.

5. A golf tee as claimed in claim 1, wherein the tee further comprises a shaft, the writing point being coaxial with the shaft and contained within the shaft of the tee.

6. A golf tee as claimed in claim 5, wherein the writing point forms an end of the shaft for permitting the tee to be driven into ground.

7. A golf tee as claimed in claim 5, wherein the writing point is retractable within the shaft.

8. A golf tee as claimed in claim 3, wherein the eraser is effective to erase writing made by the writing point.

9. A golf tee as claimed in claim 1, wherein the eraser comprises the head of the tee.

10. A golf tee as claimed in claim 9, wherein the eraser further comprises the shaft of the tee.

11. A golf tee as claimed in claim 1, wherein the eraser comprises a ring received in a channel around the head of the tee.

12. A golf tee as claimed in claim 1, wherein the shaft is constructed from eraser material.

13. A golf tee as claimed in claim 1, wherein the tee has a a shaft with a head at one end, the other end of the shaft ending in a point, and a hollow bore extending from the head into the shaft.

14. A golf tee as claimed in claim 13, wherein a plurality of such tees is adapted to nest one in another, the hollow bore of one tee being adapted to receive a point of a shaft of a first adjacent tee, the point of the shaft of the one tee being adapted to be received in a hollow bore of a second adjacent tee.

15. The golf tee of claim 1, wherein the tee includes an eraser chosen from the group consisting of rubber and felt.

16. The golf tee of claim 1, wherein the writing point is retractable.

17. The golf tee of claim 1, wherein the eraser is effective to erase writing made by the writing point.

18. The golf tee of 17, wherein the eraser is configured to function as a shock absorber.

19. The golf tee of claim 1, wherein the head of the tee is adapted to receive one of a ball marker or a disc, the eraser being made of a resilient material and forming a ledge for holding the one of a disc or a marker.

20. The golf tee of claim 15, wherein the eraser is effective to erase writing made by the writing point.

21. The golf tee of claim 15, wherein the eraser is configured to function as a shock absorber.

22. The golf tee of claim 1, wherein the tee further comprises a shaft and wherein the writing point forms a part of the shaft.

23. The golf tee of claim 1, wherein the eraser is located near the head of the tee.

24. The golf tee of claim 9, wherein the eraser is affixed to the shaft.

25. The golf tee of claim 11, wherein the ring comprises an "O" ring.

26. The golf tee of claim 15, wherein the writing point is retractable.

27. A golf tee comprising:

a shaft with first and second ends;

an enlarged head defining a hollow depression to provide a concave surface for supporting a golf ball located at the first end of the shaft;

a hollow bore extending from the enlarged head into the shaft;

an eraser located at the head; and a writing point located at the second end; and wherein the eraser is effective to erase writing made by the writing point.

28. A golf tee as claimed in claim 27, wherein the writing point is chosen from the group consisting of pencil lead, ball point with associated ink reservoir and crayon.

29. The golf tee of claim 28, wherein the eraser is chosen from the group consisting of rubber and felt.

30. A golf tee as claimed in claim 27, wherein the writing point is retractable within the shaft.

31. A golf tee as claimed in claim 27, wherein at least a part of the second end of the shaft is made from a material which is capable of use as the writing point.

32. A golf tee as claimed in claim 27, wherein the writing point is shaped to permit the tee to be driven into ground.

33. A golf tee as claimed in claim 27, wherein the eraser comprises the head of the tee.

34. A golf tee as claimed in claim 33, wherein the eraser also forms the shaft of the tee.

35. A golf tee as claimed in claim 33, wherein the eraser is configured to function as a shock absorber.

36. A golf tee as claimed in claim 33, wherein the head of the tee is adapted to receive one of a disc and a ball marker, the eraser being made of resilient material and forming a ledge for holding the disc or marker.

37. A golf tee as claimed in claim 27, wherein the eraser comprises a ring received in a channel around the head of the tee.

38. A golf tee as claimed in claim 37, wherein the ring comprises an "O" ring.

39. A golf tee as claimed in claim 27, wherein the hollow bore together with the enlarged end defines an open cavity into the shaft.

40. A golf tee as claimed in claim 39, wherein the tee is adapted to nest with other tees of the same type, the open cavity of one tee being adapted to receive a second end of a first adjacent tee, the second end of the one tee being adapted to be received in an open cavity of a second adjacent tee.

41. A golf tee as claimed in claim 30, wherein the hollow bore contains a retracting mechanism for retracting the writing point within the shaft.

42. A golf tee as claimed in claim 33, wherein the eraser forming the head of the tee has an extension adapted to be received within the hollow bore.

* * * * *

UNITED STATES PATENT AND TRADEMARK OFFICE

CERTIFICATE OF CORRECTION

PATENT NO. : 6,224,501 B1 
DATED : May 1, 2001
INVENTOR(S) : Dickory Rudduck et al.

It is certified that error appears in the above-identified patent and that said Letters Patent is hereby corrected as shown below:

Column 5,
Line 11, delete "The golf tee of 17," and substitute -- A golf tee as claimed in claim 17, -- in its place.
Line 13, delete "The golf tee of claim 1," and substitute -- A golf tee as claimed in claim 1, -- in its place.
Line 17, delete "15," and substitute -- 14, -- in its place.
Line 19, delete "15," and substitute -- 14, -- in its place.

Signed and Sealed this

Eighteenth Day of June, 2002

*Attest:*

*Attesting Officer*

JAMES E. ROGAN
*Director of the United States Patent and Trademark Office*